United States Patent [19]

Droller et al.

[11] Patent Number: 4,682,968

[45] Date of Patent: Jul. 28, 1987

[54] FIGURE TOY WITH RAPIDLY RETRACTABLE TRAP ELEMENT

[75] Inventors: Richard Droller, Prospect; Richard I. Farrington, New Britain, both of Conn.

[73] Assignee: Coleco Industries, Inc., West Hartford, Conn.

[21] Appl. No.: 832,812

[22] Filed: Feb. 21, 1986

[51] Int. Cl.[4] ..... A63H 3/00

[52] U.S. Cl. ..... 446/268; 446/315; 446/490

[58] Field of Search ..... 446/486, 327, 315, 314, 446/490, 268, 304

[56] References Cited

U.S. PATENT DOCUMENTS

| | | | |
|---|---|---|---|
| 1,101,048 | 6/1914 | Adamson . | |
| 3,328,910 | 7/1967 | Hughes | 446/315 |
| 3,353,823 | 11/1967 | Sobel . | |
| 3,577,676 | 5/1971 | Powell . | |
| 3,983,661 | 10/1976 | Zitzmann | 446/315 |
| 4,469,327 | 9/1984 | Ulrich et al. . | |

*Primary Examiner*—Philip C. Kannan

[57] ABSTRACT

A creature figure toy has an extensible tongue component, which may cooperate with the string by which it is secured to provide a trap for capturing objects. Abrupt retraction of the tongue component may be effected by pulling a tail component, attached to a second string, the effective length of which may be multiplied by a unique arrangement of tumblers and spools disposed within the body of the toy.

18 Claims, 13 Drawing Figures

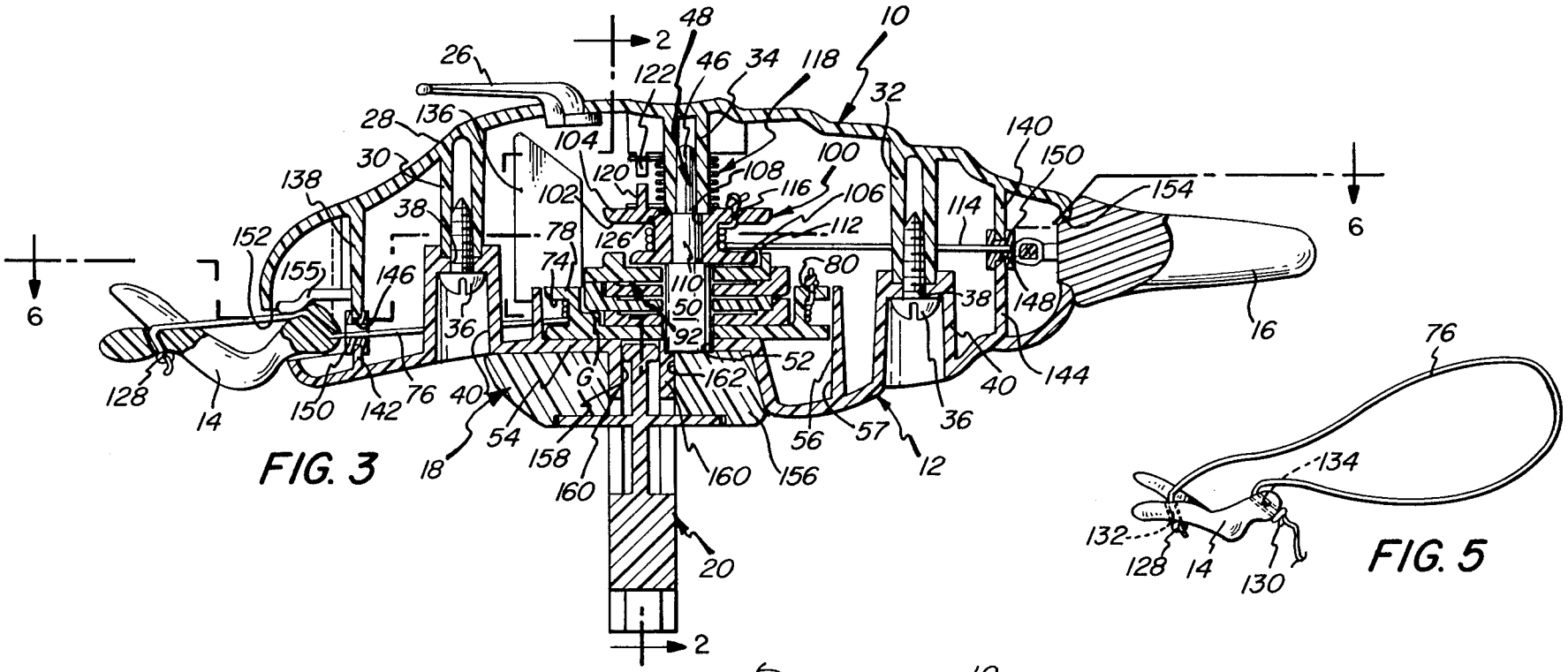
FIG. 3
FIG. 5
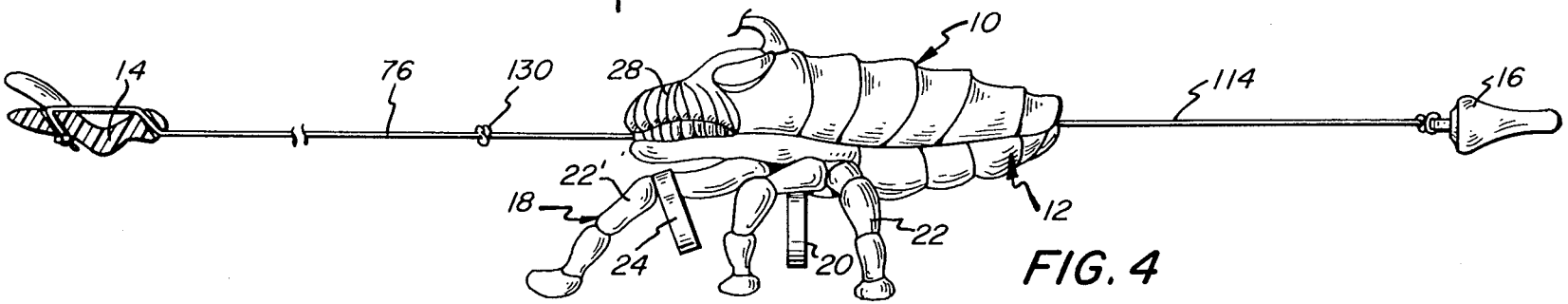
FIG. 4

FIGURE TOY WITH RAPIDLY RETRACTABLE TRAP ELEMENT

BACKGROUND OF THE INVENTION

An ongoing demand exists for action toys having novel features. It is of course important that any such toy be effective in its appearance and operation, while also being durable and relatively facile and inexpensive to manufacture. The prior art discloses numerous forms of action toys in which various parts can be moved in different ways, and which achieve a wide diversity of effects; typical are the following U.S. patents:

Adamson U.S. Pat. No. 1,101,048 shows a toy snake drawn by a string along an undulating wire.

In Sobel U.S. Pat. No. 3,353,823, a string is ejected by squeezing a bottle or a frog-like body, to simulate squirting liquid or tongue movement, respectively; in the latter case, the string may have a loop formed at its end to engage an object.

A similar squeeze toy is shown in Powell U.S. Pat. No. 3,577,676; the string may be attached to a plug, to facilitate return into the body of the toy, and it may have a magnet on its free end for "catching" objects.

Ulrich U.S. Pat. No. 4,469,327 provides a game device wherein manipulation of a tail portion of the figure causes its neck to curve upwardly and rearwardly.

Application for U.S. Letters Pat. Ser. No. 06/703,333, entitled CORD-CLIMBING CREATURE, filed in the name of Francis R. Amici on Feb. 20, 1985 (now U.S. Pat. No. 4,576,586) and of common assignment herewith, discloses a simulated creature having a winch assembly in its body with portions of different diameters. Lengths of a string-like member extend about both portions of the winch assembly and out the front and rear of the body; under the force of gravity, the string-like member winds more rapidly about the smaller diameter winch portion, causing the creature to "climb" the forwardly extending length of string.

It is believed that Playskool Company has used a tumbler arrangement in a toy clock for the purpose of preventing overwinding of the power spring. The spring could be wound through a limited number of revolutions, after which a stop element would prevent further rotation; release would simultaneously drive the clock mechanism and reset the tumblers.

It is an object of the present invention to provide a novel toy having a manually extensible and retractable element.

It is a more specific object of the invention to provide such a toy wherein retraction of the extensible element is effected by extending a second element.

Another object of the invention is to provide such a toy in form of a creature figure, wherein the first extensible element extends from a head portion of the figure and the second extensible element extends in the opposite direction from a tail portion thereof.

A related object is to provide such a creature figure toy wherein the element that extends from the head portion simulates a tongue and is attached to the retraction mechanism by a string which cooperates with the tongue component to form a trap for capturing objects.

Still another object of the invention is to provide a toy having the foregoing features and advantages, which utilizes a unique spool assembly for multiplying the effect of the retraction element.

Additional objects of the invention are to provide such a toy which is effective in its appearance and utility, is durable, and is relative facile and inexpensive to manufacture.

SUMMARY OF THE INVENTION

It has now been found that certain of the foregoing and related objects of the invention are achieved by the provision of a toy, including a body having an internal cavity with two spaced passages into it, and a spool assembly contained therewithin. The components of the spool assembly comprise a first, relatively large diameter spool, and a second, relatively small diameter spool. The spools are mounted for rotation about a common axis, and they have engagement elements which are configured and disposed for operative interengagement in first and second rotatably displaced relationships, preventing relative rotation of the spools therebeyond in both directions and permitting substantially free relative rotation thereof through an arc between the points of interengagement. First and second flexible lines are provided, which have their inner end portions wound upon the first and second spools, respectively, and which have their outer end portions extending through the two passages and outwardly of the body; the inner end portions of the lines are wound upon their respective spools in opposite directions, and the effective length of the inner end portion of the "second" line is lesser than that of the "first". Normally, the spool assembly will include a biasing member operatively connected between the body and the "second" spool, the biasing member being energized by rotation of the latter, through extension of the "second" line, so as to cause it to exert an opposite rotational force upon the spool.

Assuming that the engagement elements of the spools are operatively interengaged in the "first" relationship defined, and that the inner end portion of the "first" line is so wound that unwinding will cause the "first" spool to rotate in one direction with the engagement element moving toward the "second" relationship thereof, the "first" line can be extended from the body to cause it to rotate, relative to the "second" spool, through the arc therebetween and into the "second" relationship of the elements, with the "second" spool remaining substantially stationary. The "second" line can thereafter be extended from the body to rotate the "second" spool, in turn rotating the "first" spool through interengagement of the engagement elements, in the direction opposite to the "one" direction to thereby rewind the "first" line inner end portion. The biasing member will simultaneously be conditioned to rewind the inner end portion of the "second" line when the force extending it is released.

In the preferred embodiments, the spool assembly components will include at least one tumbler that is mounted between the spools for rotation about the same axis. An engagement element provided on the tumbler will be disposed for operative interengagement with the engagement elements of both of the spools in both directions of rotation; it will be angularly interposed therebetween in both the "first" and the "second" relationships defined, and it will have an arc of free relative rotation between the points of interengagement. As a result, extension of the "first" line, with the elements in the "first" relationship, will cause the "first" spool to rotate in the "one" direction so as to move the engagement element thereof from one side of the "first" tumbler element to the other. Further extension of the "first" line will effect conjoint rotation of the "first" spool and the tumbler in the "one" direction, to move the engagement element of the tumbler from one side of the "second" spool element to the opposite side thereof, thereby attaining the "second" relationship of the engagement elements. Thus, the tumbler will permit unwinding of an additional length of the "first" line, corresponding substantially to the length of the arc of free relative rotation that it provides.

Most desirably, the spool assembly components will include a second such tumbler coaxially mounted for rotation between the first-mentioned tumbler and one of the spools. The "second" tumbler will also have an engagement element thereon, disposed for operative interengagement with the engagement elements of the other of the components, in both directions, and angularly interposed between the elements of the "first" tumbler and the spool to which it is adjacent in both such relationships. An arc of free relative rotation provided by the "second" tumbler will permit unwinding of a further length of the "first" line, again corresponding to the length of the arc.

The components of the spool assembly will advantageously comprise body portions of disc-like configuration, with lugs extending radially from the circumference thereof providing the engagement elements. The lugs on the tumblers may extend along and axially beyond the body portions thereof, so as to effect the transfer the movement from the components adjacent thereto, and the lugs on the two spools will generally extend in opposite radial directions from one another. It will, in some instances, be desirable to form a cavity of circular cross section into one side of the body portion of at least one of the spools, dimensioned and configured to rotatably seat the adjacent component therewithin, and a similar feature may advantageously be provided by the tumblers as well.

The body of the toy will normally have an internal spindle, with each of the components of the spool assembly having a central aperture through which the spindle extends for rotatably mounting them. The "first" spool will desirably carry a resiliently deflectable element which extends into its central aperture and bears upon the spindle, to create a drag force thereupon and a consequential retardation of rotation; this will tend to maintain the angular position of the "first" spool during rewinding of the "second" line upon the "second" spool.

The body will most desirably be of creature-like form, with the passages thereof oriented diametrically with respect to the spool assembly components and with the "first" and "second" lines having tongue- and tail-simulating components attached to them, respectively. The tongue-simulating component may be configured to permit the "first" line to be formed into a loop, the toy thereby being adapted to perform a capturing function by engagement of an object within the line loop.

BRIEF DESCRIPTION OF THE DRAWINGS

FIG. 3 is a sectional view taken along the longitudinal centerline of the toy;

FIG. 4 is an elevational view (for illustrative purposes only, since the condition depicted would not exist in actuality) showing both the tongue component and also the tail component extended outwardly from the body;

FIG. 5 is a fragmentary view of the tongue component and the line by which it is attached, the latter being formed into a loop;

DETAILED DESCRIPTION OF THE ILLUSTRATED EMBODIMENT

Figure 1:
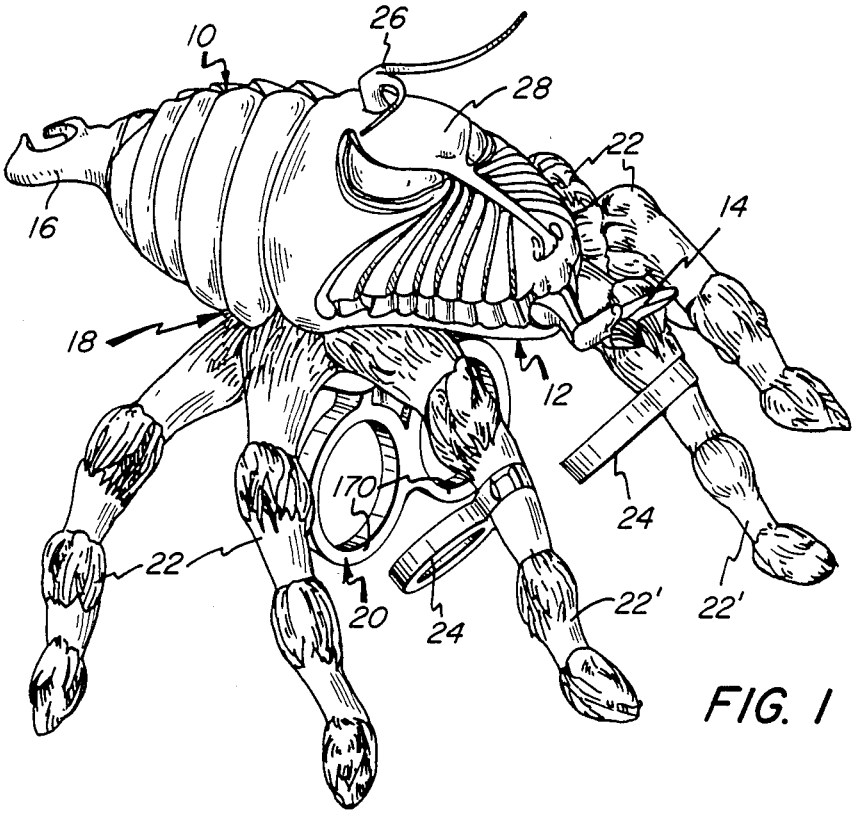
FIG. 1 is a perspective view of a creature figure toy embodying the present invention.
Figure 2:
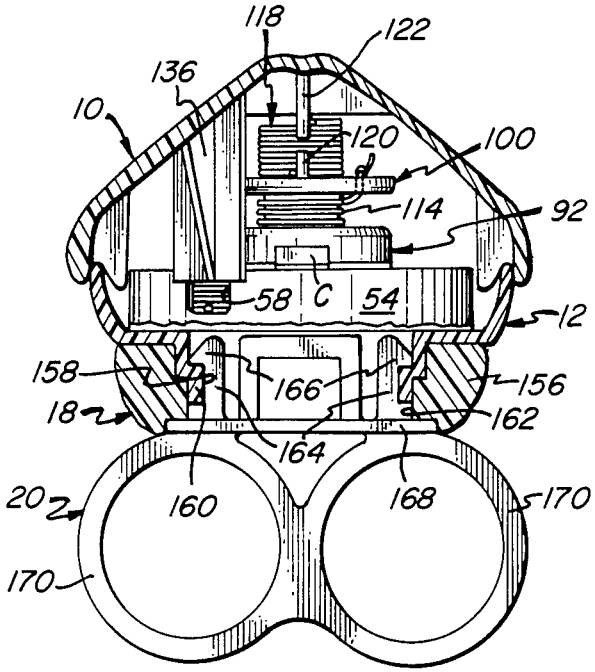
FIG. 2 a sectional view, taken along line 2—2 of FIG. 3, showing the internal mechanism for operating the extensible element of the toy, and also showing details of the rigid holder by which it may be supported.

Turning now in detail to the appended drawings, therein illustrated is a creature figure toy embodying the invention, consisting of a body formed as upper and lower (in the normal position of the toy) hollow sections, generally designated respectively by the numerals 10, 12, tongue and tail components 14, 16, respectively, a leg piece, generally designated by the numeral 18, and a rigid gripping piece, generally designated by the numeral 20. The leg piece 18 is integrally formed from a resilient material (e.g., PVC of 50 Durometer value) to provide six flexible leg-simulating appendages 22, the two forwardmost ones 22' of which can be animated by the attached finger-engaging elements 24; an antenna-simulating piece 26 is affixed within a head portion 28 formed on the upper body section 10. As will be appreciated, toys embodying the invention may take a wide diversity of forms, albeit that figure toys, such as the fantastic, insect-like creature illustrated, will generally be preferred.

The upper section 10 of the body has three hollow depending post elements 30, 32, 34, the elements 30 and 32 serving to receive screws 36, which extend through apertures 38 formed in web portions at the inner ends of cooperating cylindrical elements 40, formed into the lower body section 12 and registering therewith. The screws 36 cooperate with round pins 42, which extend from the upper body section into the hexagonal openings 44 formed into the bottom section 12, to maintain the body halves in assembly.

The third post element 34 frictionally engages the upper, relatively small diameter end portion 46 of a spindle, which is of stepped cylindrical form and is generally designated by the numeral 48, upon which the components comprising the spool assembly, constituting the operating mechanism for the toy, are supported. The relatively large base portion 50, at the opposite end of the spindle 48, is supported within an opening 52 of corresponding diameter, formed into a planar wall portion 54 of the lower section 12. A cylindrical wall formation 56 extends upwardly within the lower body section 12 and concentrically with respect to the opening 52, and is slotted at 58 to provide a radial passage into the circular receptacle 57 defined therebetween, at a location offset angularly from the longitudinal axis of the toy body.

Figure 8:
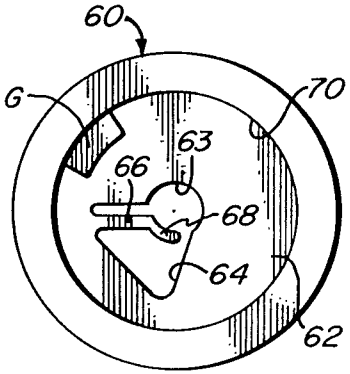
FIG. 8 is a plan view of the larger spool employed in the spool assembly.

A relatively large spool, generally designated by the numeral 60, is rotatably mounted upon the base portion 50 of the spindle 48 in contact with the upper surface of the planar wall portion 54. As can be seen in FIG. 8, the aperture in the body portion 62 of the spool 60 is comprised of an arcuate section 63 and a triangular section 64 which communicates therewith, into which projects a finger 66 having a curved tip element 68. The element 68 is contoured to bear upon the base portion 50 of the spindle 48, which is received within the arcuate section 63 of the aperture, with a substantial area of the two elements in surface contact, thereby creating a frictional drag force to retard free rotation of the spool 60; the purpose for doing so will be discussed more fully below.

One side of the spool 60 is formed with an upwardly opening circular recess 70, into which projects radially a lug element "G"; the lug element comprises an arcuate section, laterally defined by radii of the circular body portion. A U-shaped groove 74 extends about the outer circumference of the spool 60, and serves to contain the inner portion of the forward string 76, which is attached to the tongue component 14. As can be seen, the annular element 78 at the upper rim of the groove 74 has a small hole 80, through which the inner end of the string 76 passes and is knotted to secure it to the spool 60, winding of the string thereabout being best illustrated in FIGS. 3, 6, 12 and 13.

Figure 7:
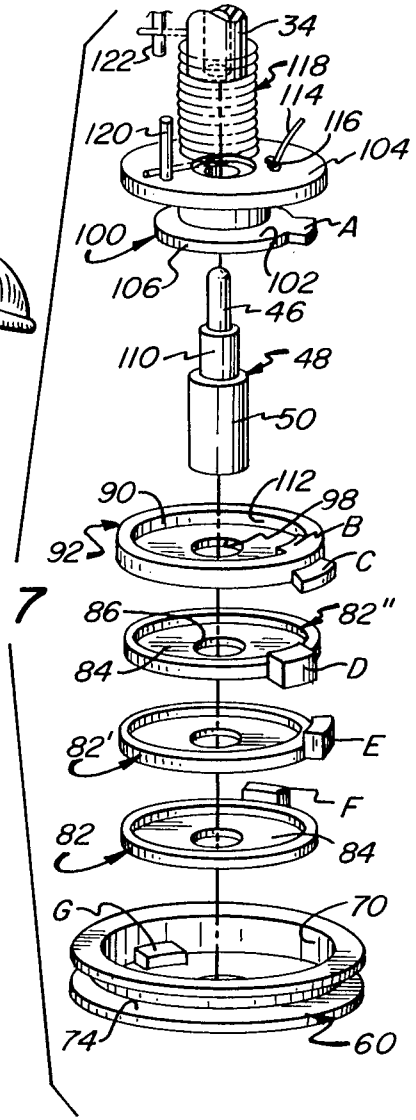
FIG. 7 is an exploded perspective view of the operating mechanism for the extensible element.
Figure 6:
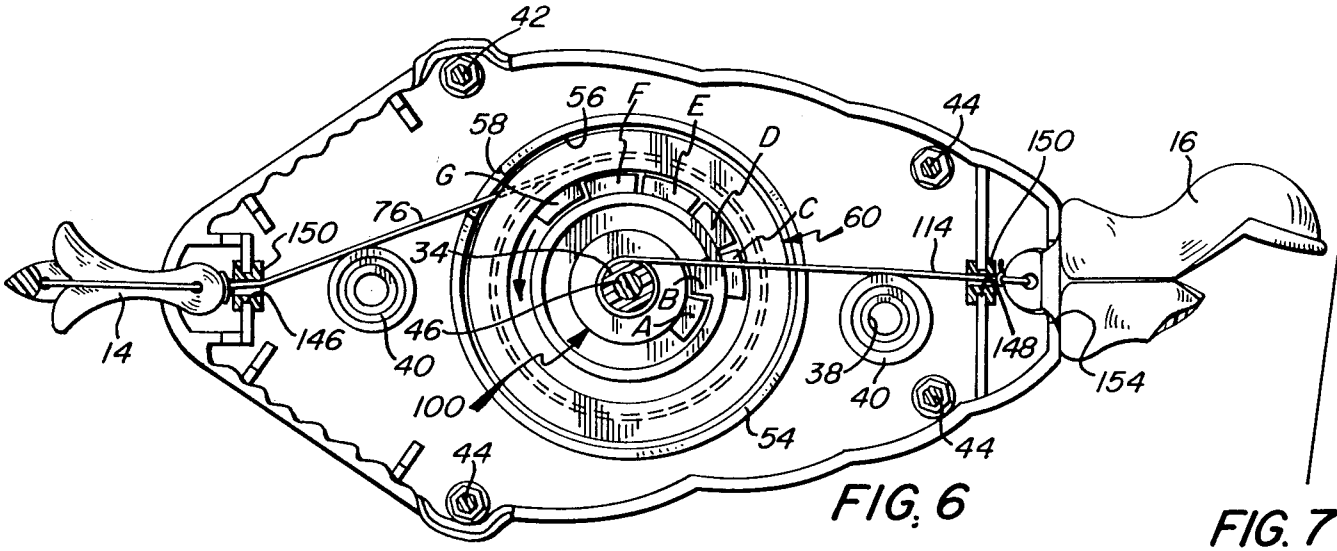
FIG. 6 is a sectional view taken along line 6—6 of FIG. 3.
Figure 10:
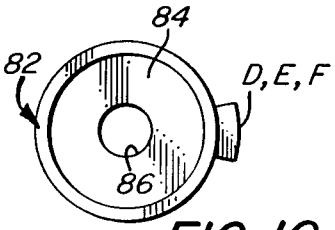
FIG. 10 is a plan view of an intermediate tumbler.
Figure 9:
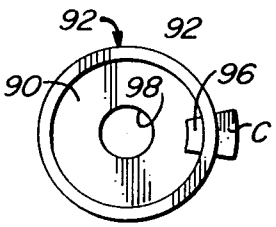
FIG. 9 is a plan view of the uppermost tumbler employed in the assembly.
Figure 11:
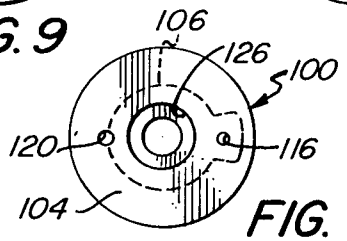
FIG. 11 is a plan view of the smaller spool.

Rotatably seated within the circular recess 70 of the spool 60 is the lowermost tumbler, generally designated by the numeral 82 and best seen in FIGS. 7 and 10. The two superjacent tumblers of the stack, 82' 82", are identical thereto, and description of tumbler 82 will therefore suffice to describe all three components. It consists of a disc-like body portion 84, having a central aperture 86 by which it is rotatably mounted upon the base portion 50 of the spindle 48, and a lug element extending radially outwardly from a point on the circumference thereof. Like the lug element G, elements "F", "E" and "D" on tumblers 82, 82' and 82", respectively, are formed as arcuate sections; these lug elements are however approximately twice the height of the body portion 84, so that they extend upwardly (i.e., axially) along the outer circumference of the overlying component. Thus, lug element "F" extends along the body portion of tumbler 82', element "E" extends along the body portion of tumbler 82", and element "D" extends along the body portion 90 of the uppermost tumbler, which is generally designated by the numeral 92 and is specifically shown in FIG. 9.

Tumbler 90 is of substantially the same construction as tumblers 82, except that it has two radially aligned lug elements "B", "C" thereon, element "C" extending radially outwardly from the circumferential edge of the body portion 90 and element "B" extending inwardly therefrom. The body portion 90 has a central aperture 98 formed through it, by which it is also rotatably mounted upon the enlarged base portion 50 of the spindle 48.

The upper spool, generally designated by the numeral 100, has a U-shaped groove 102 extending about its circumference, defined between upper and lower annular elements 104, 106, respectively. It has a central aperture 108 for rotatably mounting it upon the central portion 110 of the spindle 48, which is of a diameter intermediate that of the portions 46 and 50. The uppermost tumbler 92 has a circular recess 112 formed into one side, within which the lower annular element 106 of the spool 100 is seated; as will be appreciated, the telescoped relationship of the several components provides a compact spool assembly, thereby minimizing the amount of space that must be allotted to it within the body of the toy. A circular reces 126 is formed into the surface of the element 104; it receives the lower end of the depending post 34, which thereby serves to retain the components of the spool assembly in position on the spindle 50.

The groove 102 of the spool 100 serves to contain the inner end portion of the string 114, which attaches the tail component 16 to the winding mechanism. The annular element 104 is formed with a small hole 116 to receive the inner end of the string 114, which is knotted to secure it to the spool. A torsion spring, generally designated by the numeral 118, is disposed upon the depending post 34 of the upper body section 10, with one end bearing upon an upstanding pin 120 provided on the spool 100, and with the other end bearing upon a similar pin 122 depending from the upper section. Rotation of the spool 100 in the clockwise direction (as viewed in FIGS. 6, 7, 12 and 13) will tend to wind the spring 118, thereby storing energy for effecting rotation in the opposite direction. A lug element "A", similar to those previously described, extends radially outwardly from the circumference of the annular element 106.

Operation is as follows: Taking the tongue and tail components 14, 16 to be in the positions shown in FIGS. 1, 3 and 6, the components of the spool assembly will be in the relationships illustrated; i.e., the spools and tumblers are positioned with lug elements A, B/C, D, E, F and G ganged in counterclockwise sequence, string 76 is wound in a clockwise direction about spool 60, and string 114 is wound counterclockwise about spool 100. Extension of tongue component 14 will cause the string 76 to rotate the lower spool 60 counterclockwise, with the lug element G moving through an arc of about 310° from its initial position against one side of lug element F, of adjacent tumbler 82, to the opposite side thereof, the differential from a full 360° circle being attributable to the angular width of the two lug elements, which is about 25° in each instance. Continued withdrawal of the tongue component 14 will cause the tumbler 82 to rotate with the spool 60, due to interengagement of their lug elements, with element F moving from one side of element E to the opposite side thereof; as will be appreciated, interengagement occurs because lug element F extends upwardly along the circumferential edge of the body portion 84 of tumbler 82'. Similar action occurs sequentially in the remaining components of the spool assembly as the string 76 is extended further, with lug element E contacting lug element D to rotate member 82", lug element D thereafter contacting element C to rotate tumbler 92, and with lug element B thereof ultimately contacting element A of the upper spool 100. At that point further extension of the tongue component 14 is prevented, since spool 100 is restrained against counterclockwise rotation by engagement of the tail component 16 upon the body of the toy; the resultant relationship of the components, rotatably displaced from their original positions, is shown in FIG. 12.

In this condition, it may be desirable to "set" the trap, which is comprised of the tongue component 14 and the attached string 76, which is knotted at 128 and 130 and is slidably threaded through the apertures 132, 134 of the component 14. The string can be pulled through the aperture 134 to the configuration shown in FIG. 5, providing a loop which can be placed about an object to be captured; the knot 130 limits the size of the loop, as a safety feature.

Figure 12:
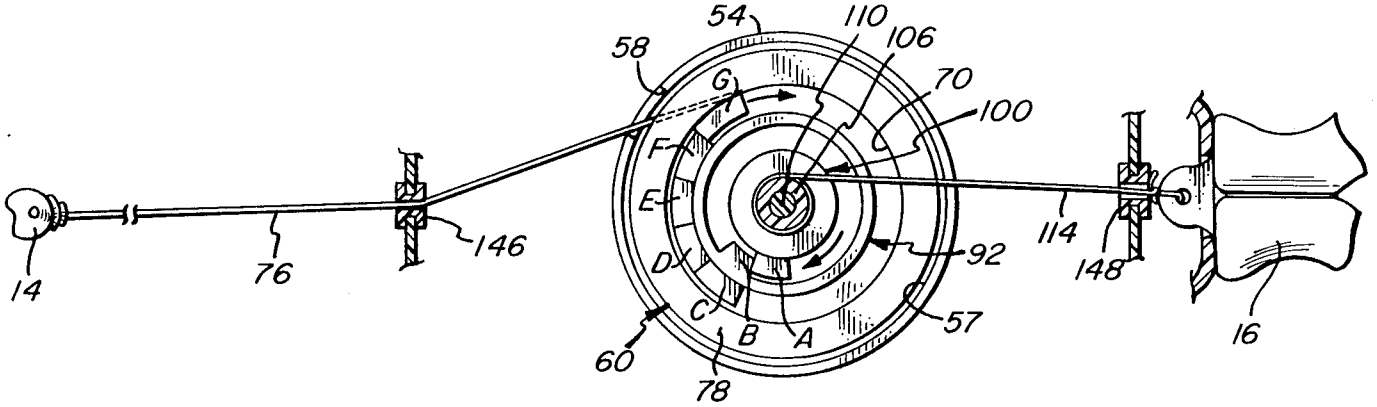
FIG. 12 is a fragmentary representation showing the tongue component extended and the tail component in its fully retracted position.
Figure 13:
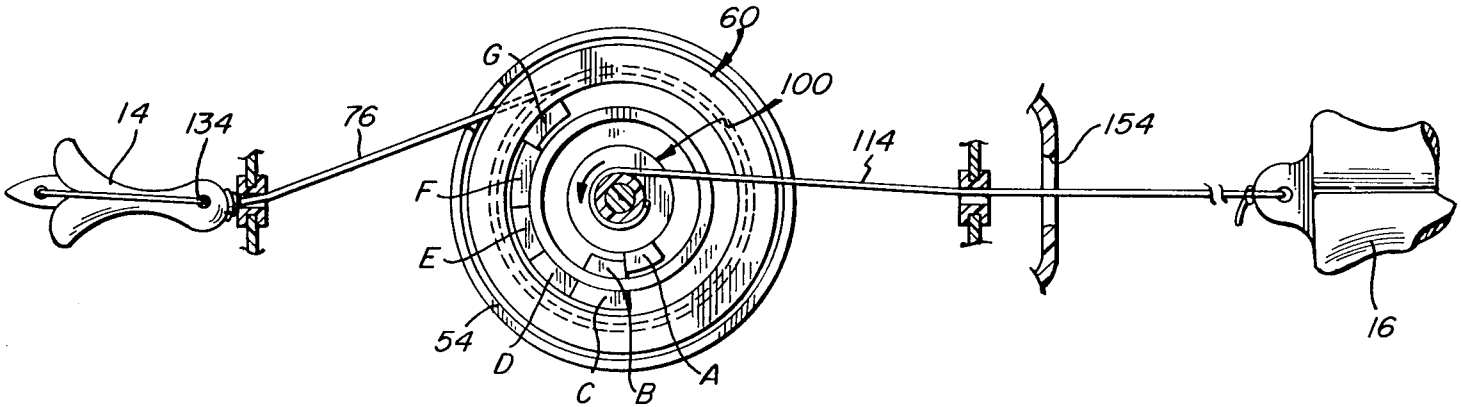
FIG. 13 is a similar representation showing the tail component extended and the tongue component fully retracted.

Retraction of the tongue component is effected by extending the tail component 16 from the position shown in FIG. 12 to that of FIG. 13. In doing so, the spool 100 is caused to rotate in the clockwise direction, thereby returning all of the tumblers 82, 82', 82'', 92 and the lower spool 60 to their original positions, by virtue of the ganged relationship of their lug elements caused by the prior extension of the forward string 76. The torsion spring 118 attached to the upper spool 100 will simultaneously be wound, thereby storing energy to permit automatic return of the tail component 16 to its position against the body, through rewinding of the attached string 114, upon release. As indicated above, the biasing element 66 of the lower spool 60 creates a level of drag upon the spindle 48 sufficient to maintain it in its reestablished (initial) position, despite the tendency of the rotating upper spool 100, acting by frictional contact through the other components of the assembly, to displace it therefrom.

The body sections are constructed to provide suitable guides for the operating strings, and also to accommodate the tongue and tail components. As previously indicated, the cylindrical wall 54 which surrounds the lower spool 60 is slotted at 58 to permit passage of the string 76. A baffle plate 136 projects from the upper body section 10 downwardly in front of the slot 58 and contributes to the proper guidance of the string 76. Flange elements 138, 140, 142 and 144 extend transversely from the body sections, the elements 138 and 142, and the elements 140 and 144, respectively, registering with one another and defining circular apertures 146, 148 therebetween. Within each of the apertures is seated a brass eyelet 150, which provides a guide for the associated string 76 or 114. A mouth opening 152 is formed between the body sections to permit partial entry of the tongue component 14, and a rear opening 154 is similarly formed to permit limited engagement of a correspondingly shaped protrusion on the tail component 16. An L-shaped deflectable finger component 155 is affixed adjacent the mouth opening 152, to snap over an element of the tongue component 14 and thereby disengageably hold it in its fully retracted position.

As will be appreciated, the forward string 76 is much longer than the rearward one 114; typically, they will be 18 and 9 inches, respectively. The shorter tail string can nevertheless effect full and abrupt retraction of the longer tongue string because of the relative circumferential lengths of the grooves in the spools 60, 100; obviously, the lengths of the two strings could be proportioned differently by changing the relative sizes of the two spools. Furthermore, due to the arcs of relative rotation that are afforded by the tumblers 82, 82', 82'' and 92, each of which must turn through almost a full circle before operative interengagement occurs between the lug element G, on the lower spool, and element A on the upper one, the tongue string can be extended a substantial distance without need for the upper spool to rotate.

As indicated previously, the leg member 18 is integrally formed to simulate six leg-like appendages 22, 22', which are joined to a common trunk portion 156, disposed under the lower body section 12. The latter has an opening 158 therethrough defined between wall elements 160, which depend from the wall portion 54 and pass into an opening 162 formed through the trunk portion 156 of the leg piece 18. The rigid holder 20 is formed with a pair of deflectable prongs 164, which have outwardly directed barbed components 166 at their free ends to catch upon shoulders formed in the wall elements 160. Thus, the holder is snap-fit within the body opening 162 by insertion of the prongs 164 to the position shown, thereby also securing the leg piece 18 in place, the holder having a flange portion 168 thereon which bears upon the trunk portion 156 to enhance the level of support provided.

The ring pieces 24 are formed with relatively large and relatively small ring sections, interconnected by a relatively narrow throat section, and they are mounted upon the two forward leg elements 22' by engagement within the smaller ring sections; the larger ring sections are dimensioned and configured to receive the tip of a finger. As will be apparent, the toy is supported on the operator's hand by inserting two of his fingers (normally the first two) through the openings of the side-by-side ring portions 170 of the holder 20, with the tips of the same fingers conveniently being engaged within the relatively large sections of the ring pieces 24, simultaneously enabling stable support of the toy and movement of the forward leg elements 22', for animation of the figure.

Materials of construction used for the several parts of the toy will be readily apparent to those skilled in the art, and it will be appreciated that plastic fabrication will normally predominate. Typically, resins such as ABS copolymer, acetal copolymer, and PVC will be utilized; the strings will desirably be lines of twisted nylon strands.

Thus, it can be seen that the present invention provides a novel toy having a manually extensible element, which can be retracted by extending a second element thereof. The toy may be in the form of a creature figure, with the first extensible element extending from a head portion and the second extensible element extending from a tail portion thereof. The element that extends from the head portion may simulate a tongue, which is attached to the retraction mechanism by a string that cooperates with the tongue component to form a trap for capturing objects. In addition, the invention provides a unique spool assembly for multiplying the effect of the retraction element, and the toy is effective in its appearance and utility, is durable, and is relative facile and inexpensive to manufacture.

Having thus described the invention, what is claimed is:

1. A toy having a manually extensible and retractable element, comprising:

a body with an internal cavity having two spaced passages thereinto;

a spool assembly contained within said body cavity and comprised of a plurality of components including a first, relatively large diameter spool and a second, relatively small diameter spool, said spools being mounted for rotation about a common axis and each having an engagement element thereon, said engagement elements being configured and disposed for operative interengagement in first and second rotatably displaced relationships so as to prevent relative rotation of said spools therebeyond in both directions, and to permit substantially free relative rotation thereof through an arc between the points of interengagement;

a first flexible line having an inner end portion wound upon said first spool, and having an outer end portion extending through one of said passages outwardly of said body;

a second flexible line having an inner end portion wound upon said second spool in the direction opposite to the direction of winding of said first line inner end portion, and having an outer end portion extending outwardly of said body through the other of said passages, the effective length of said inner end portion of said second line being lesser than that of said first line; and a biasing member operatively connected between said body and said second spool, rotation of said second spool, by extension of said second line to unwind said inner end portion thereof, energizing said biasing member so as to cause it to exert an opposite rotational force upon said second spool;

whereby, with said engagement elements of said spools operatively interengaged in said first relationship, and with said inner end portion of said first line so wound that unwinding thereof will cause said first spool to rotate in one direction with said elements moving toward said second relationship, said first line can be extended from said body to cause said first spool to rotate in said one direction and relative to said second spool through said arc and into said second relationship of said elements, with said second spool remaining substantially stationary, and whereby said second line can thereafter be extended from said body to rotate said second spool and, through interengagement of said elements, said first spool in the direction opposite to said one direction, to thereby rewind said first line inner end portion upon said first spool, such extension of said second line also energizing said biasing member and conditioning said member to rewind said inner end portion of said second line upon said second spool and to return said second spool to its position in said first and second relationships.

2. The toy of claim 1 wherein at least one component of said spool assembly is a tumbler mounted between said spools for rotation about said common axis, said tumbler having an engagement element thereon disposed for operative interengagement with said engagement elements of both of said spools in both said directions and angularly interposed therebetween in said first and second relationships, with said tumbler having an arc of free relative rotation between said points of interengagement, extension of said first line, with said elements in said first relationship, causing said first spool to rotate in said one direction to move said element thereof from one side of said first tumbler element to engagement with the opposite side thereof, further extension of said first line, and rotation of said first spool thereby, effecting conjoint rotation of said tumbler in said one direction to move said element thereof from a position adjacent one side of said second spool element to a position adjacent the opposite side thereof, to attain said second relationship of said elements, said tumbler permitting unwinding of an additional length of said first line corresponding substantially to the length of said arc of free relative rotation thereof.

3. The toy of claim 2 wherein said spool assembly components include a second said tumbler mounted between said first-mentioned tumbler and one of said spools for rotation about said common axis, said second tumbler having an engagement element thereon disposed for operative interengagement with said engagement elements of the other of said components in both said directions and interposed angularly between said elements of said first tumbler and said one spool in both of said relationships, with said second tumbler having an arc of free relative rotation between said points of interengagement and permitting unwinding of a further length of said first line corresponding to the length of said arc of relative rotation.

4. The toy of claim 3 wherein said components of said spool assembly comprise body portions of disc-like configuration, and wherein said engagement elements are lugs extending radially from the circumferences of said body portions.

5. The toy of claim 4 wherein said lug of said first tumbler extends along and axially beyond said body portion thereof to effect the transfer of movement with a component adjacent thereto.

6. The toy of claim 4 wherein said lug of one of said spools extends radially inwardly and that of the other of said spools extends radially outwardly, and wherein one of said tumblers has lug portions extending in both radial directions and operative in effecting the transfer of movement between said spools.

7. The toy of claim 1 wherein said body portion of one of said spools has a cavity of circular cross section formed into one side thereof, the adjacent component being rotatably seated within said cavity.

8. The toy of claim 1 wherein said toy includes a spindle affixed on said body, each of said components having a central aperture through which said spindle extends for rotatably mounting them thereupon.

9. The toy of claim 8 wherein said first spool has a resiliently deflectable element thereon extending into said aperture thereof and bearing upon said spindle to create rotation-retarding drag force, said deflectable element thereby tending to maintain the angular position of said first spool during rewinding of said second line upon said second spool.

10. The toy of claim 1 wherein said body is in the form of a creature figure.

11. The toy of claim 10 wherein said passages of said body are oriented diametrically with respect to said spool assembly components, and wherein said first and second lines have attached thereto, respectively, tongue- and tail-simulating components.

12. The toy of claim 11 wherein said tongue-simulating component is configured to permit forming said first line into a loop, said toy thereby being adapted to perform a capturing function by engagement of an object within said line loop.

13. A creature figure toy having a manually extensible and retractable element, comprising:

a creature-simulating body with an internal cavity having two spaced passages thereinto;

a spool assembly contained within said body cavity and comprised of a plurality of components including a first, relatively large diameter spool, a second relatively small diameter spool, and a plurality of tumblers interposed therebetween, said components being mounted for rotation about a common axis and each having an engagement element thereon, said engagement elements of adjacent components being configured and disposed for direct interengagement in two rotatably displaced positions so as to prevent relative rotation therebeyond in both directions, and to permit substantially free rotation thereof through an arc between the points of interengagement, all of said engagement elements of said components being in operative interengagement at both of two rotatably displaced extreme positions with said engagement elements in ganged relationship;

a first flexible line having an inner end portion wound upon said first spool, and having an outer end portion extending through one of said passages outwardly of said body; and a second flexible line having an inner end portion wound upon said second spool in the direction opposite to the direction of winding of said first line inner end portion, and having an outer end portion extending outwardly of said body through the other of said passages, the effective lengths of said inner end portion of said second line being lesser than that of said first line; whereby, with said engagement elements of said components operatively interengaged in said first relationship, and with said inner end portion of said first line so wound that unwinding thereof will cause said first spool to rotate in one direction with said elements moving toward said second relationship, said first line can be extended from said body to cause said first spool to rotate in said one direction and relative to the adjacent tumbler through said arc therebetween, and to thereafter cause said adjacent tumbler and the other component that is adjacent thereto to rotate relative to one another through said arc therebetween, ultimately bringing said engagement elements to said second relationship thereof with said second spool remaining substantially stationary, and whereby said second line can thereafter be extended from said body to rotate said second spool and, through interengagement of said elements, the other of said components in the direction opposite to said one direction, to thereby rewind said first line inner end portion upon said first spool.

14. The toy of claim 13 wherein said spool assembly additionally includes a biasing member operatively connected between said body and said second spool, with rotation of said second spool by such extension of said second line energizing said biasing member so as to cause it to exert an opposite rotational force upon said second spool, whereby such extension of said second line will so energize said biasing member and will condition said member to rewind said inner end portion of said second line upon said second spool and to return said second spool to its position in said first and second relatonships.

15. The toy of claim 14 wherein said components of said spool assembly comprise body portions of disc-like configuration, and wherein said engagement elements are lugs extending radially from the circumferences of said component body portions.

16. The toy of claim 14 wherein said toy includes a spindle affixed on said body, each of said components having a central aperture through which said spindle extends for rotatably mounting them thereupon.

17. The toy of claim 16 wherein said first spool has a resiliently deflectable element thereon extending into said aperture thereof and bearing upon said spindle to create rotation-retarding drag force, said deflectable element thereby tending to maintain the angular position of said first spool during rewinding of said second line upon said second spool.

18. The toy of claim 13 wherein said passages of said body are oriented diametrically with respect to said spool assembly components, and wherein said first and second lines have attached thereto, respectively, tongue- and tail-simulating components, said tongue-simulating component being configured to permit forming said first line into a loop, said toy thereby being adapted to perform a capturing function by engagement of an object within said line loop.

* * * * *